United States Patent [19]

Swayne

[11] 3,972,181

[45] Aug. 3, 1976

[54] TURBINE COOLING AIR REGULATION

[75] Inventor: Kenny M. Swayne, North Palm Beach, Fla.

[73] Assignee: United Technologies Corporation, Hartford, Conn.

[22] Filed: Mar. 8, 1974

[21] Appl. No.: 449,583

[52] U.S. Cl. ..... 60/39.66; 415/115; 415/116; 416/97 R

[51] Int. Cl.[2] ..... F02C 7/18; F01D 5/14; F01D 5/18

[58] Field of Search ..... 60/39.66; 415/115, 116; 416/97, 95

[56] References Cited

UNITED STATES PATENTS

| | | | |
|---|---|---|---|
| 2,787,440 | 4/1957 | Thompson, Jr. | 415/116 |
| 2,811,833 | 11/1957 | Broffitt | 60/39.66 |
| 2,848,192 | 8/1958 | Hayes | 416/97 |
| 2,896,906 | 7/1959 | Durkin | 415/115 |
| 3,015,937 | 1/1962 | Giliberty | 415/116 |
| 3,703,808 | 11/1972 | Stearns | 60/39.66 |
| 3,826,084 | 7/1974 | Branstrom et al. | 60/39.66 |

*Primary Examiner*—Carlton R. Croyle
*Assistant Examiner*—Thomas I. Ross
*Attorney, Agent, or Firm*—Jack N. McCarthy

[57] ABSTRACT

Turbine cooling air regulation is obtained by directing cooling air through turbine cooling valve means to manifold means located internally of the roots of blades mounted on a turbine rotor disk. The manifold means has sealing engagement with the rotor disk and directs air from within, through passages to the interior of the blade where it passes through openings on the surface of the blade. The cooling system can include a plurality of turbine cooling valves which can be operated in unison, or independently actuated and scheduled.

10 Claims, 5 Drawing Figures

TURBINE COOLING AIR REGULATION

The invention herein described was made in the course of or under a contract or subcontract with the Department of the Air Force.

BACKGROUND OF THE INVENTION

This invention relates to turbine blade cooling and particularly for blades in a gas turbine powerplant. A turbine coolant flow system is shown in U.S. application Ser. No. 411,124 now U.S. Pat. No. 3,826,084.

SUMMARY OF THE INVENTION

A primary object of the invention is to provide a turbine cooling air regulation device which will improve specific fuel consumption of a gas turbine engine by restricting the turbine cooling air at the lower turbine inlet temperature operating conditions found at "cruise" or "low power settings".

In accordance with the present invention, the turbine cooling air regulation device attempts to prevent hot gas inflow into the blades and not upset the rotor thrust balance during regulation.

In accordance with a further aspect of the present invention, the turbine cooling valves in the cooling air flow open a pressure compensating orifice as the cooling airflow to the turbine blades is shut off.

In accordance with an aspect of the invention, cooling air is fed to manifolds which discharge cooling air between two seals of equal diameter thereby preventing rotor thrust balance variations due to opening and closing of the turbine cooling valves.

Another object of the invention is to provide means for directing cooling air to a high pressure and low pressure turbine. In this arrangement the blades of the high pressure turbine receive continuous flow of cooling air to the leading edge thereof while the flow regulation is directed only to the trailing edge.

DESCRIPTION OF THE PREFERRED EMBODIMENT

Figure 1:
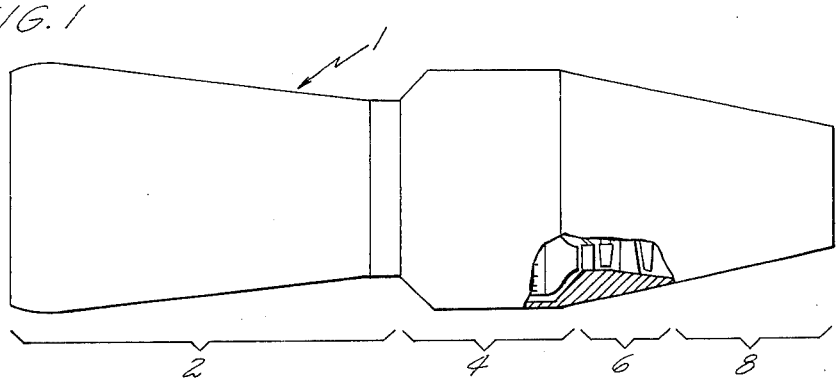
FIG. 1 is a side elevational view of a turbojet engine showing the location of the invention.
Figure 2:
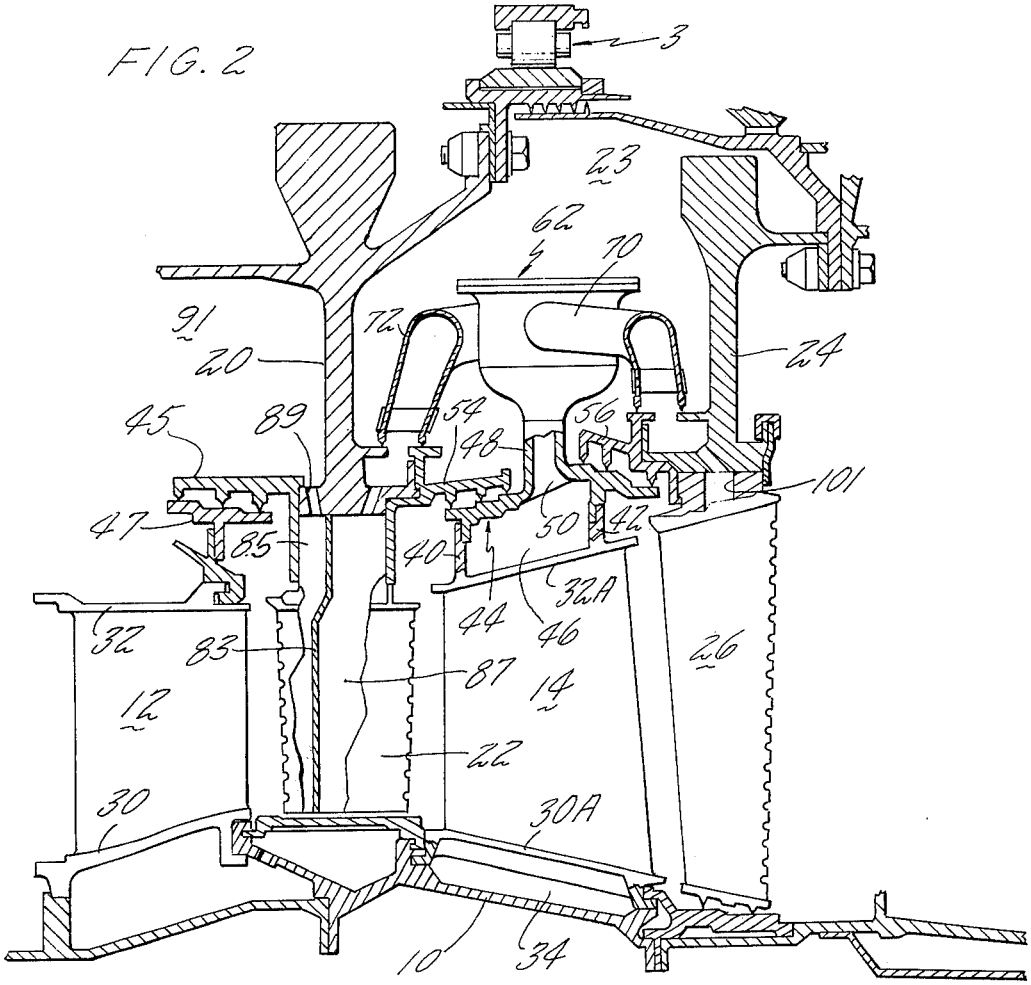
FIG. 2 is an enlarged view of the turbine section showing a turbine cooling valve connected thereto.
Figure 3:
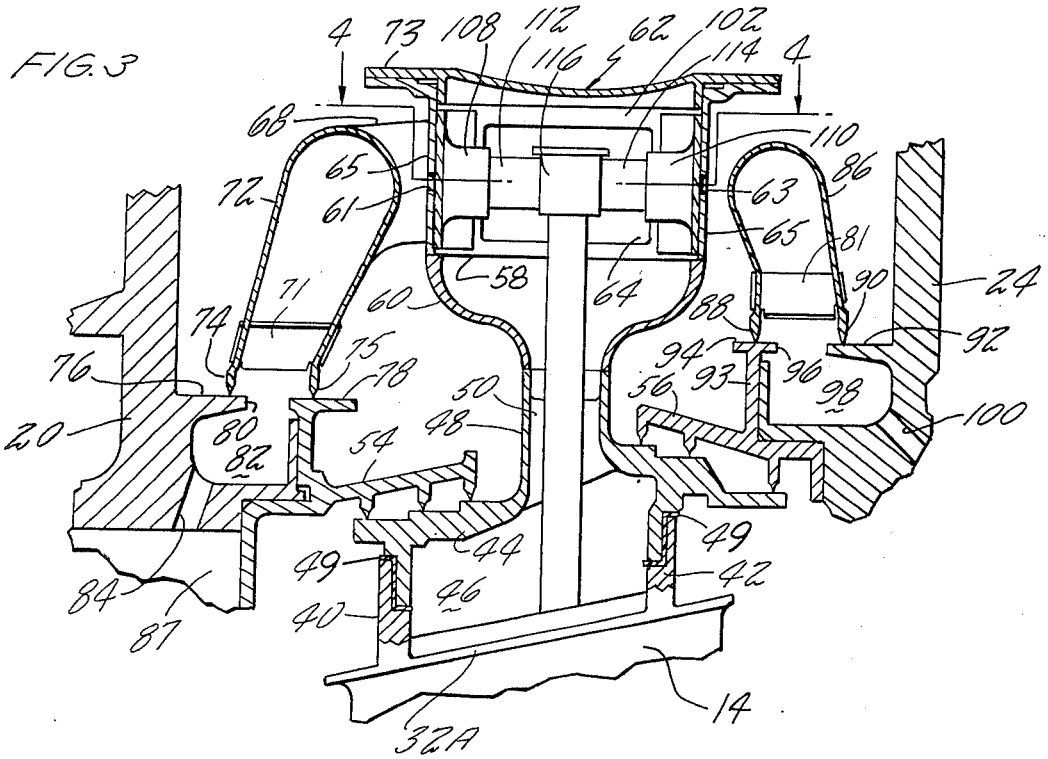
FIG. 3 is an enlarged sectional view of the turbine cooling valve.
Figure 4:
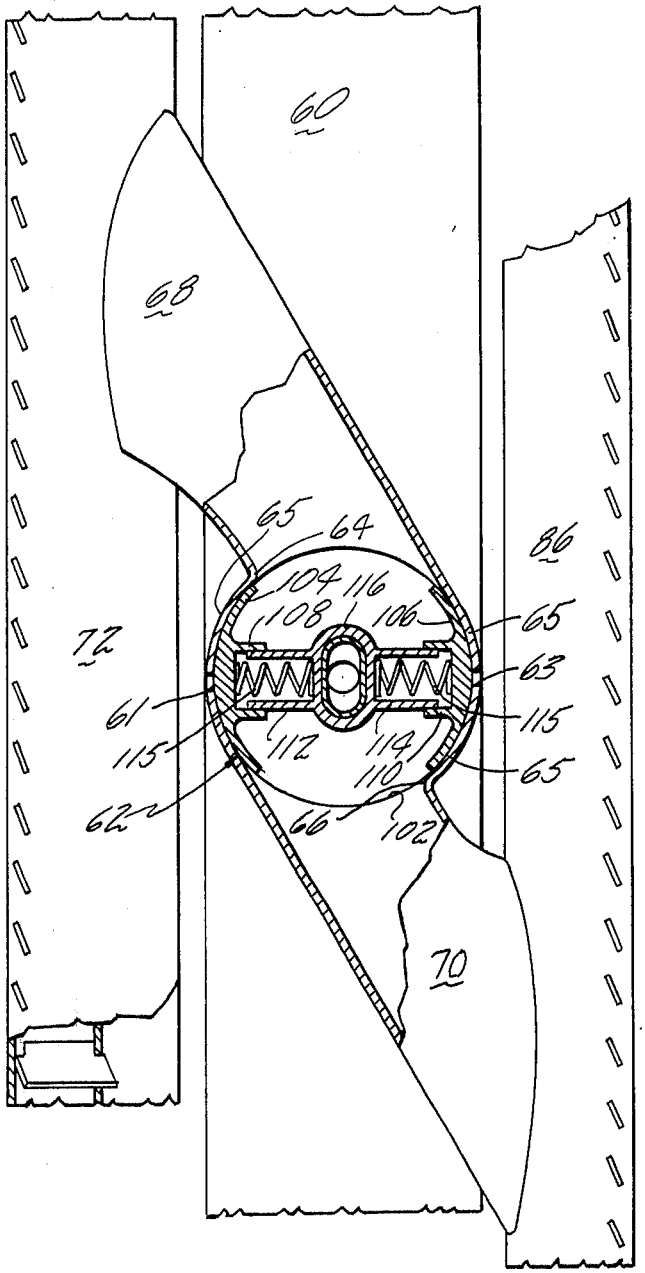
FIG. 4 is a view taken along the line 4—4 of FIG. 3.

Referring to FIG. 1 a gas turbine powerplant 1 is shown, and the powerplant has a compressor section 2, a combustion section 4, a turbine section 6 and an exhaust section 8. The turbine section 6 is broken away to locate the invention. An enlarged view of this section is shown in FIG. 2. This view shows the outer casing 10 of the powerplant with turbine vanes 12 and 14 being connected thereto and extending inwardly. These vanes 12 and 14 have their outer platforms 30 and 30A, respectively, forming an annular outer shroud and their inner platforms 32 and 32A, respectively, forming an annular inner shroud. The combustion section 4 directs its hot combustion products into the annular opening formed between the annular outer shroud 30 and annular inner shroud 32 of vanes 12.

A high pressure turbine rotor disk 20 is mounted for rotation in the engine, including bearing assembly 3, and has blades 22 mounted thereon which extend between the turbine vanes 12 and 14. A low pressure turbine disk 24 is positioned rearwardly of turbine disk 20 and is mounted (not shown) for independent rotation thereof and has blades 26 positioned rearwardly of the turbine vanes 14. The turbine blades 22 and 26 can be connected to their respective turbine disks 20 and 24 by any manner desired.

Figure 5:
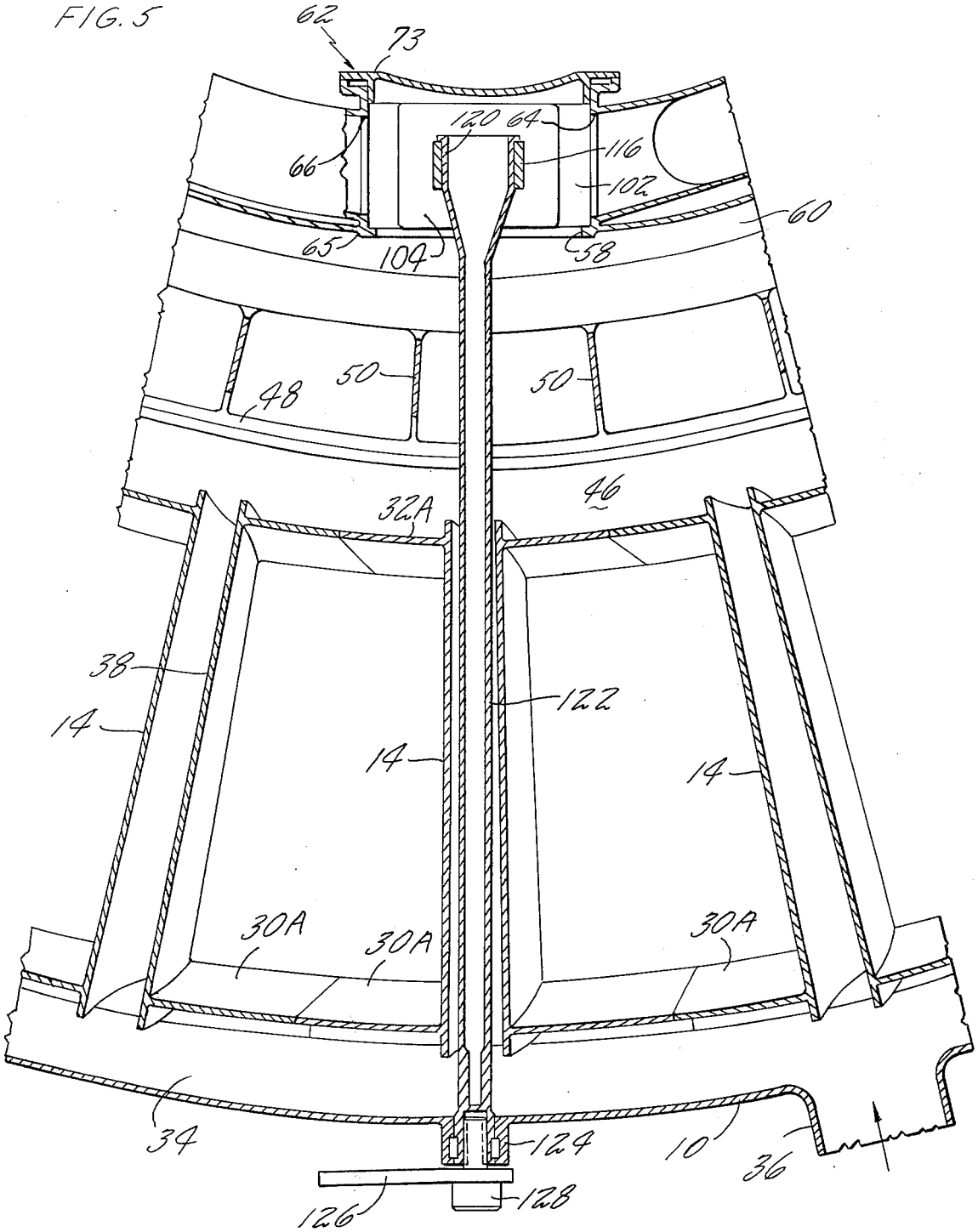
FIG. 5 is a transverse sectional view taken through the turbine section and turbine cooling valve.

An annular manifold 34 is formed between the outer casing 10 and annular shroud formed by outer platforms 30A of turbine vanes 14. A duct 36 (see FIG. 5) directs cooling air to the manifold 34. Vanes 14 are hollow as shown at 38 permitting cooling air to flow from the annular manifold 34 to the inner ends of the vanes. The inner platforms 32A of the vanes 14 also have an inwardly extending front flange member 40 which forms an inwardly extending annular flange with the other front flange members of the other vanes 14. The inner platforms 32A of the vanes 14 also have an inwardly extending rear flange member 42 which forms an inwardly extending annular flange with the other rear flange members 42 of the other vanes 14. An annular member 44 extends between the inner edges of the front annular flange formed by the front flange members 40 and the rear annular flange formed by the rear flange members 42 forming an annular manifold 46. An annular seal means 49 seals the space between flange members 40 and 42, and their connection to annular member 44. This annular member 44 has a radially extending passageway 48 extending around its entire periphery. Vanes 50 connect the forward and rearward sides of the passageway 48 to properly space the sides and support them.

The rotor disk 20 and blades 22 have a rearwardly extending annular flange member 54 fixed thereto which extends within the forward part of annular member 44 in front of passageway 48. Sealing means are provided between the stationary annular member 44 and rotating annular flange 54. The rotor disk 20 and blades 22 also have a forwardly extending annular flange member 45 which forms a sealing arrangement with fixed structure 47 of the engine which is in turn fixed to the inner platforms 32 of the vanes 12. The rotor disk 24 and blades 26 have a forwardly extending annular flange 56 fixed thereto which extends within the rearward part of annular member 44 behind passageway 48. Sealing means are provided between the stationary annular member 44 and rotating annular flange 56.

An annular manifold 60 is connected to the inner circumference of the radially extending passageway 48. It can be seen that cooling air at the inner ends of the vanes 14 passes into annular manifold 46 and then through radially extending passageway 48 into annular manifold 60. A plurality of turbine cooling valves 62 are located on the inner periphery of the manifold 60. Each turbine cooling valve 62 includes a housing 65 which has an opening 58 in the bottom thereof which is connected to the interior of manifold 60 providing an inlet for cooling air into said housing. Said housing has two outlet openings 64 and 66 through which cooling air can pass from said housing to the exterior thereof. The housing also has compensating orifices 61 and 63 to compensate for the cavity pressure $P_c$ when the cooling air is shut off. This cavity pressure $P_c$ is the pressure in the cavity 23 formed between the rotor disks 20 and 24 and the interconnecting sealing means. The orifices 61 and 63 are sized to allow enough air to enter cavity 23 to maintain rotor thrust balance and prevent hot gas inflow. Outlet opening 64 has a conduit 68 connected thereto and opening 66 has a conduit 70 connected thereto.

Conduit 68 extends to a high pressure turbine feed manifold 72 which is located between the rear of the rotor disk 20 and the turbine cooling valves 62 on manifold 60. The manifold 72 is open at its outer periphery having a forward sealing edge 74 and a rearward sealing edge 75, both having the same diameter from the engine centerline, this prevents changes in rotor thrust as flow is regulated. Vanes 71 are connected between the forward and rearward sides of the manifold 72 to provide rigidity for the manifold, and they are angled so as to direct flow from said manifold in the direction of rotation of the rotor disk 20. Sealing edge 74 cooperates with a sealing surface 76 which extends from the rotor disk 20 and rearward sealing edge 75 cooperates with a sealing surface 78 which is connected to annular flange 54 by an inwardly extending annular flange. An annular opening 80 is formed between sealing surface 76 and sealing surface 78, this opening being connected to an annular chamber 82 formed by the rotor disk 20 and inwardly extending flange of annular flange 54. The rotor disk 20 has a plurality of passageways 84 therein connecting the annular chamber 82 to the interior of each of the blades 22.

Each blade 22 includes a partition 83 which divides the blade into a forward compartment 85 and rearward compartment 87. The passageway 84 is shown extending into the rearward compartment 87. The controlled cooling airflow in this compartment is directed through openings in the trailing edge of the blade. The forward compartment 85 is continuously fed a flow of cooling air through passageway 89 in the rotor disk 20. Passageway 89 opens into a rotating compartment 91 formed by the rotor disk 20 and sealing members connected thereto. This compartment may be fed cooling air from a turbine coolant flow system such as shown in copending application Ser. No. 411,124 now U.S. Pat. No. 3,826,084. Other systems can be used to direct the cooling flow to the chamber 91 such as from a direct connection from a compressor stage.

Conduit 70 extends to a low pressure turbine feed manifold 86 which is located between the front of the rotor disk 24 and the turbine cooling valves 62 on manifold 60. The manifold 86 is open at its outer periphery having a forward sealing edge 88 and a rearward sealing edge 90, both having the same diameter from the engine center line. Vanes 81 are connected between the forward and rearward sides of the manifold 86 to provide rigidity for the manifold, and they are angled so as to direct flow from said manifold in the direction of rotation of the rotor disk 24. Sealing edge 90 engages a sealing surface 92 which extends from the rotor disk 24 and forward sealing edge 88 engages a sealing surface 94 which is connected to annular flange 56 by an inwardly extending annular flange 93. An annular opening 96 is formed between sealing surface 92 and sealing surface 94, this opening being connected to an annular chamber 98 formed by the rotor disk 24 and inwardly extending flange 93 of annular flange 56. The rotor disk 24 has a plurality of passageways 100 therein each connecting the annular chamber 98 to a passageway 101 in the root of the blade which extends to the interior of each of the blades 26.

Each turbine cooling valve 62 includes a recessed cylindrical bore 102 therein in which the two outlet openings 64 and 66 are located 180° apart. Two valving members 104 and 106 of arcuate shape are located in the bore 102 of the housing 65, said valving members being adapted to engage the surface of said recessed bore and sized to provide for opening or closing the outlet openings 64 and 66. A valve cap 73 has a cylindrical flange extending into the bore to restrict longitudinal movement of the valving members. These valving members are also located 180° apart so that the valving members in one position will uncover the two outlet openings 64 and 66 while covering the compensating orifices 61 and 63 and in a second position they will uncover the compensating orifices 61 and 63 and cover the two outlet openings 64 and 66.

The two valving members 104 and 106 have a short cylindrical section 108 and 110, respectively, for receiving mating cylindrical sections 112 and 114, respectively, which are connected to a center hub 116. A spring 115 is located in mating cylindrical sections 108 and 112 and section 110 and 114, to bias the valving members 104 and 106 against the wall of the recessed bore 102. This hub has an elongated opening at the center thereof which receives a mating portion 120 of an actuating rod 122.

This construction permits the actuating rod 122 to rotate the valving members 104 and 106 between a position where the openings 64 and 66 are closed and a position where the openings 64 and 66 are open. Each actuating rod 122 extends radially outwardly from its valve 62 passing between vanes 50 in the passageway 48 and through the interior of a turbine vane 14 to the exterior of the casing 10. The inner end of the actuating rod 122 has an outwardly extending flange which connects the inner end of its cooperating center hub 116, while the outer end which projects through a boss 124 on the casing 10 has a lever 126 fixed thereto. The lever 126 can be fixed to the free end of the rod 122 by any means desired, however it is shown connected to the rod with a bolt 128 threadably engaging the center of the actuating rod 122.

The levers 126 of the plurality of turbine cooling valves 62 can be connected to a synchronizing ring arrangement so that when the ring is actuated all of the valves will be operated in unison. However, each lever 126 of a plurality of turbine cooling valves 62 can be mechanically interconnected so that if there are, for example four valves, one valve would be opened at idle, a second would be opened when the cooling air requirement exceeded that which was delivered by the first valve at which time the second valve would be opened, and so on until the fourth valve would be opened to provide enough cooling air flow for maximum turbine inlet temperature.

I claim:

1. In a gas turbine engine having a compressor, a combustion section, and a turbine section, said turbine section having a turbine rotor mounted for rotation with turbine blades mounted therearound, a cooling manifold being located rearwardly of said turbine rotor and inwardly of said turbine blades, turbine vanes located in said turbine section rearwardly of said turbine blades, said cooling manifold having first opening means at its outer periphery, said turbine rotor having second opening means connected to the interior of said blades, said outer periphery of said cooling manifold having sealing cooperation around its first opening means with the second opening means of said turbine rotor, said first opening means and said second opening means being radially aligned, a plurality of said turbine blades having openings therein connecting the interior of said blades to the exterior thereof, a turbine cooling valve means positioned rearwardly of said cooling manifold and radially inwardly of said turbine vanes to direct cooling fluid to said cooling manifold, a supply of cooling fluid, a first manifold means located radially inwardly from the turbine vanes, a second manifold means located around the turbine vanes, a plurality of said turbine vanes being hollow for connecting said second manifold means to said first manifold means, means for actuating said turbine cooling valve means, said actuating means including an actuating rod extending from said turbine cooling valve means to the exterior of said turbine section, first conduit means connecting said supply to said second manifold means, second conduit means connecting said first manifold means to said turbine cooling valve means.

2. A combination as set forth in claim 1 wherein the first opening means of said cooling manifold is an annular opening formed on the outer periphery of the cooling manifold, each outer edge of the annular opening being located the same distance from the centerline of the turbine rotor.

3. A combination as set forth in claim 1 wherein said turbine blades are divided by a partition forming a forward compartment and a rearward compartment, the second opening means of said turbine rotor being connected to the rearward compartment, said turbine rotor having a third opening means connecting the area forward of the disk to the forward compartment, means for continuously supplying a cooling fluid to the third opening means.

4. A combination as set forth in claim 1 wherein a second turbine rotor having second turbine blades mounted therearound is mounted for rotation behind said turbine cooling valve means, a second cooling manifold being located forwardly of said second turbine rotor and inwardly of said second turbine blades, said second cooling manifold having third opening means at its outer periphery, said second turbine rotor having fourth opening means connected to the interior of said second blades, said outer periphery of said second cooling manifold having sealing cooperation around its third opening means with the fourth opening means of said second turbine rotor, a plurality of said second turbine blades having openings therein connecting the interior of said second blades to the exterior thereof, said turbine cooling valve means positioned forwardly of said second cooling manifold directing cooling fluid to said second cooling manifold.

5. A combination as set forth in claim 1 wherein said second conduit means comprises an annular manifold located radially inwardly from said first manifold means, said turbine cooling valve means comprises a housing extending inwardly from the inner surface of the annular manifold, said housing having an inner bore, said housing having an opening for cooling fluid flow entering said inner bore, duct means connecting said opening to said cooling manifold, a valving member slideable within said bore to open and close the bore opening, said actuating rod being connected to said valving member.

6. A combination as set forth in claim 5 wherein said bore has a second opening in said housing to permit air to enter the cavity behind the turbine rotor, said valving member closing said second opening when said cooling fluid flow opening is open and opening said second opening when said cooling fluid flow opening is closed.

7. A combination as set forth in claim 1 wherein a plurality of turbine cooling valve means are positioned rearwardly of said cooling manifold, said valve means being circumferentially spaced radially inwardly of said second conduit means, each turbine cooling valve means having an actuating rod, said actuating rods extending to the exterior of said turbine section where they can be actuated in unison or individually.

8. In a gas turbine engine having a compressor, a combustion section, and a turbine section, said turbine section having two turbine rotors mounted for rotation with turbine blades mounted therearound, a cooling manifold being located between said turbine rotors and inwardly of said turbine blades, turbine vanes located in said turbine section between said turbine blades of said two rotors, said cooling manifold having first opening means at its outer periphery, one of said turbine rotors having second opening means connected to the interior of said blades, said outer periphery of said cooling manifold having sealing cooperation around its first opening means with the second opening means of said one turbine rotor, a plurality of said turbine blades on said one turbine rotor having openings therein connecting the interior of said blades to the exterior thereof, a turbine cooling valve means positioned rearwardly of said cooling manifold and radially inwardly of said turbine vanes to direct cooling fluid to said cooling manifold, a supply of cooling fluid, means for directing said cooling fluid to said cooling valve means, first sealing means sealing each of said turbine rotors with an annular sealing member connected to the inner end of said turbine vanes, said turbine cooling valve means comprising a housing, said housing having an inner bore, said housing having an opening for cooling fluid flow entering said inner bore, duct means connecting said opening to said cooling manifold, a valving member slidable within said bore to open and close the bore opening, actuating means being connected to said valving member.

9. A combination as set forth in claim 8 wherein said bore has a second opening in said housing to permit air to enter the cavity between the turbine rotors, said valving member closing said second opening when said cooling fluid flow opening is open and opening said second opening when said cooling fluid flow opening is closed.

10. In a gas turbine engine having a compressor, a combustion section, and a turbine section, said turbine section having a turbine rotor mounted for rotation with turbine blades mounted therearound, a cooling manifold being located rearwardly of said turbine rotor and inwardly of said turbine blades, turbine vanes located in said turbine section rearwardly of said turbine blades, said cooling manifold having first opening means at its outer periphery, said turbine rotor having second opening means connected to the interior of said blades, said outer periphery of said cooling manifold having sealing cooperation around its first opening means with the second opening means of said turbine rotor, a plurality of said turbine blades having openings therein connecting the interior of said blades to the exterior thereof, a turbine cooling valve means positioned rearwardly of said cooling manifold and radially inwardly of said turbine vanes to direct cooling fluid to said cooling manifold, a supply of cooling fluid, means for directing said cooling fluid to said cooling valve means, said turbine blades being divided by a partition forming a forward compartment and a rearward compartment, the second opening means of said turbine rotor being connected to the rearward compartment, an area forward of the rotor, said turbine rotor having a third opening means connecting the area forward of the rotor to the forward compartment, means for continuously supplying a cooling fluid to said area and the third opening means.

* * * * *